US006209838B1

(12) United States Patent
Anderson et al.

(10) Patent No.: US 6,209,838 B1
(45) Date of Patent: Apr. 3, 2001

(54) RECORDING SENSOR MOUNTING RAIL FOR KEYBOARD OPERATED MUSICAL INSTRUMENTS

(75) Inventors: Denton B. Anderson, Rocklin; Wolfgang K. Fischer, Granite Bay, both of CA (US)

(73) Assignee: Burgett, Inc., Sacramento, CA (US)

( * ) Notice: Subject to any disclaimer, the term of this patent is extended or adjusted under 35 U.S.C. 154(b) by 0 days.

(21) Appl. No.: 09/294,832

(22) Filed: Apr. 19, 1999

(51) Int. Cl.[7] ..... A47B 91/00

(52) U.S. Cl. ..... 248/346.01; 248/346.03; 248/694; 84/461

(58) Field of Search ..... 248/694, 346.01, 248/346.02, 346.03, 346.5; 84/461, 462, 423 R; 361/679, 680

(56) References Cited

U.S. PATENT DOCUMENTS

| | | | |
|---|---|---|---|
| 4,974,482 | 12/1990 | Tamaki . | |
| 5,010,799 | 4/1991 | Tanaka . | |
| 5,081,892 | 1/1992 | Broadmoore . | |
| 5,237,125 * | 8/1993 | Fields | 84/626 |
| 5,546,842 * | 8/1996 | Pimentel | 84/461 |
| 5,911,169 * | 6/1999 | Lichtenstein | 84/461 |
| 5,984,255 * | 11/1999 | Reyes | 248/694 |

* cited by examiner

*Primary Examiner*—Anita M. King
*Assistant Examiner*—N. Morrison
(74) *Attorney, Agent, or Firm*—John P. O'Banion

(57) ABSTRACT

An extruded recording sensor mounting rail for keyboard operated musical instruments, particularly electronic player pianos, which can be used to install recording sensors in a new or existing piano. First and second flanges extend longitudinally along the front and rear of the mounting rail. A shelf is provided on the first flange, with the shelf configured for receiving and supporting one edge of a circuit board in a sensor assembly. The first flange includes a groove adapted to receive a threaded fastener for securing the edge of the circuit board onto the shelf. In the preferred embodiment, the second flange includes an inward facing lip which defines a flute configured for receiving and supporting the other edge of the circuit board. In the alternate embodiment, the second flange includes a shelf and a groove adapted to receive a threaded fastener for securing the other edge of the circuit board onto the shelf.

10 Claims, 6 Drawing Sheets

RECORDING SENSOR MOUNTING RAIL FOR KEYBOARD OPERATED MUSICAL INSTRUMENTS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to recording keystroke information in a keyboard operated musical instrument, and more particularly to a mounting rail assembly for supporting optical recording sensors associated with the keys, hammers, hammer shanks or hammer catchers in a piano.

2. Description of the Background Art

Recording sensors are commonly used in electronic player piano systems to capture keystroke information. Typically, sensor assemblies are mounted below the keyboard to sense the movement and position of the keys for recording the original piano performance. In conventional player piano systems, the sensor assemblies are mounted on a common rack assembly which is sized to match the size of the keyboard. Since the rack assembly must be sized to match the size of the keyboard, it is necessary to customize the rack assembly for different types of player pianos.

Currently available rack assemblies do not provide for adjustability of the position of the sensors in relation to the keys. In the piano industry, however, there are at least four distinct piano key spacing arrangements. It will be appreciated that there is a large number of individual keys to be sensed in a player piano. Further, optical sensors may be positioned for sensing the movement and position of hammers, hammer shanks, or other moving portions of the piano which are associated with the piano keys. Currently used sensor rack assemblies are generally structured and configured to be positioned beneath the piano keys themselves, and are not suitable for supporting optical sensors which detect position and motion of hammers, hammer shanks, or moving parts other than the piano keys themselves.

Thus, there is a need for an apparatus which will allow for sensing key movement without interfering with the key movement, which provides for accurate positioning of each sensor in relation to the corresponding key, and which can be used for supporting optical sensors for the detection of position and movement of hammers, hammer shanks, or like moving parts of a piano which are associated with the keys. There is a further need for sensor assemblies which can be easily retrofitted to existing pianos with varying keyboard sizes and key spacing configurations. The present invention satisfies those needs, as well as others, and overcomes the deficiencies found in conventional sensor assembly mounting techniques.

BRIEF SUMMARY OF THE INVENTION

The present invention pertains to a recording sensor mounting rail assembly for keyboard operated musical instruments, particularly electronic player pianos, which can be used to install recording sensors in a new or existing piano and provide for accurate alignment of the sensors in association with the individual keys in the instrument.

By way of example, and not of limitation, the invention comprises an elongated mounting rail which is preferably extruded as an integral component. A pair of flanges extend along the front and back edges of the mounting rail, and an open channel is defined between the flanges. Each flange includes a step or shelf that extends along the flange, with a shoulder running along the inner edge of the shelf, and a corner running along the outer edge of the shelf. A plurality of the rails may be joined together end to end in order to provide a sensor assembly which extends along the length of the keyboard of the piano.

The flange along the front edge includes an upward facing groove adapted to receive a threaded fastener therein. The step or shelf is configured to receive the front edge of a circuit board placed thereon. In the preferred embodiment, the flange along the back edge includes an inner lip that extends along the length of the back flange defining an elongated flute between the lip and the step or shelf. The flute is configured to receive the back edge of the circuit board placed therebetween. In the alternate embodiment, the back flange also includes an upwards facing groove adapted to receive a threaded fastener therein. The step of shelf is configured to receive the back edge of the circuit board placed thereon. A plurality of threaded fasteners is used to secure the circuit board onto the mounting rail.

An object of the invention is to provide a recording sensor mounting rail which permits accurate alignment of the recording sensors in relation to the keys, hammers, hammer shanks, or like moving part associated with the keys in a keyboard operated musical instrument.

Another object of the invention is to provide a recording sensor mounting rail which allows multiple rails to be connected to accommodate different sizes of keyboards.

Another object of the invention is to provide a recording sensor mounting rail which can be easily retrofitted to existing keyboards.

Another object of the invention is to provide a recording sensor mounting rail which provides for stable mounting of recording sensor assemblies.

Still another object of the invention is to provide a recording sensor mounting rail which is immutable to vibration which causes misalignment of the circuit board sensors.

Further objects and advantages of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are illustrative purposes only.

DETAILED DESCRIPTION OF THE INVENTION

Figure 1:
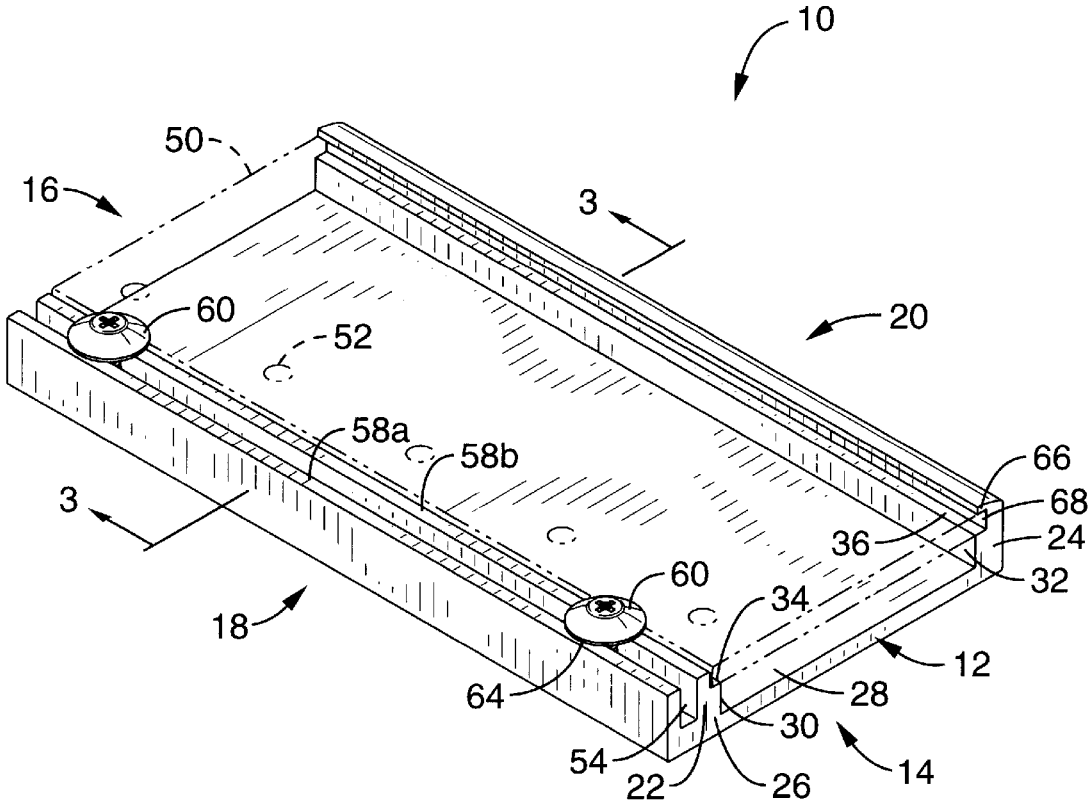
FIG. 1 is a perspective view of one embodiment of a mounting rail assembly supporting a circuit board shown in phantom.

Referring more specifically to the drawings, for illustrative purposes the present invention is embodied in the apparatus generally shown in FIG. 1 through FIG. 6, wherein like reference numerals denote like parts. It will be appreciated that the apparatus may vary as to configuration and as to details of the parts without departing from the basic concepts as disclosed herein.

Figure 2:
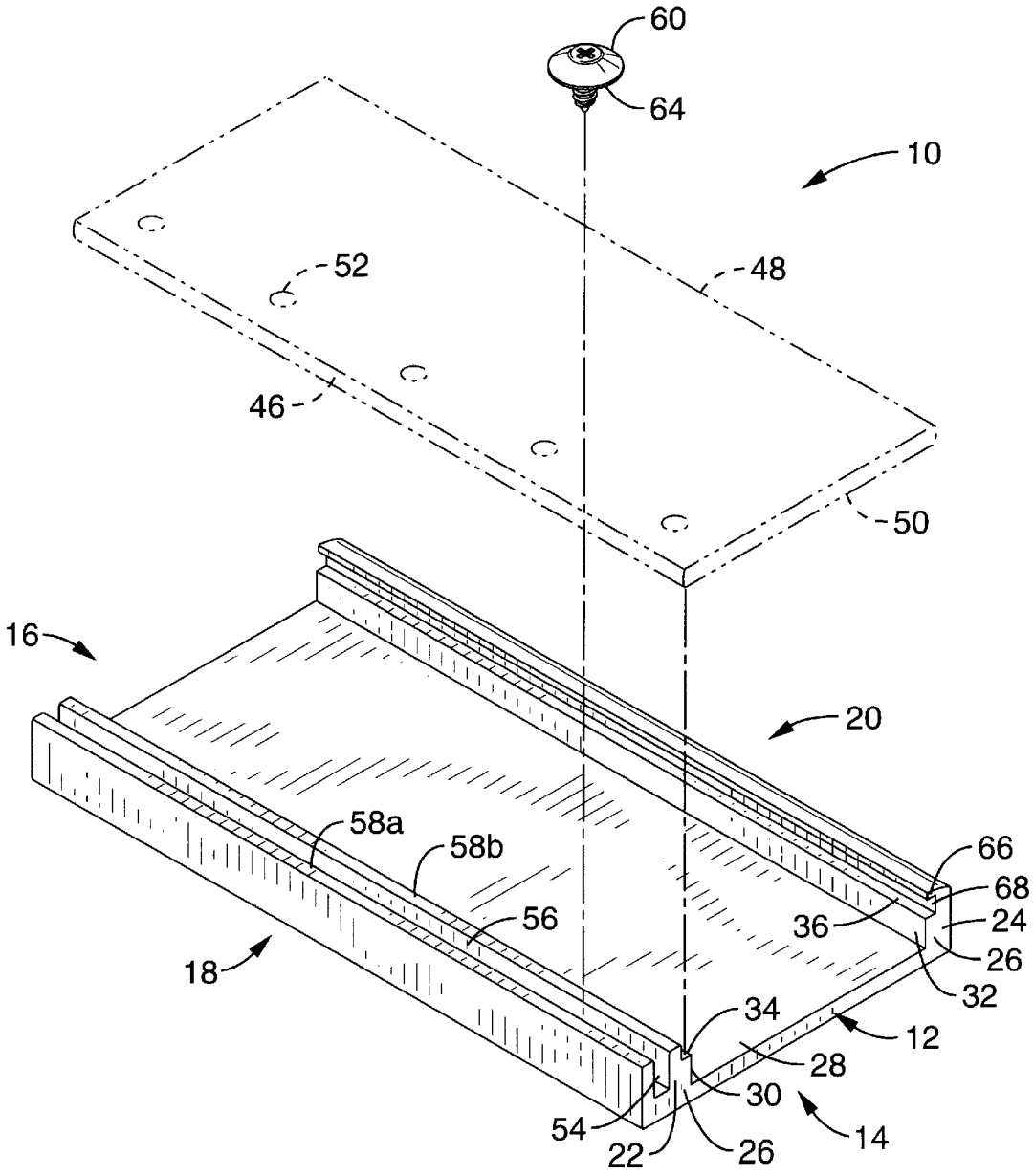
FIG. 2 is an exploded view of the assembly shown in FIG. 1.
Figure 3:
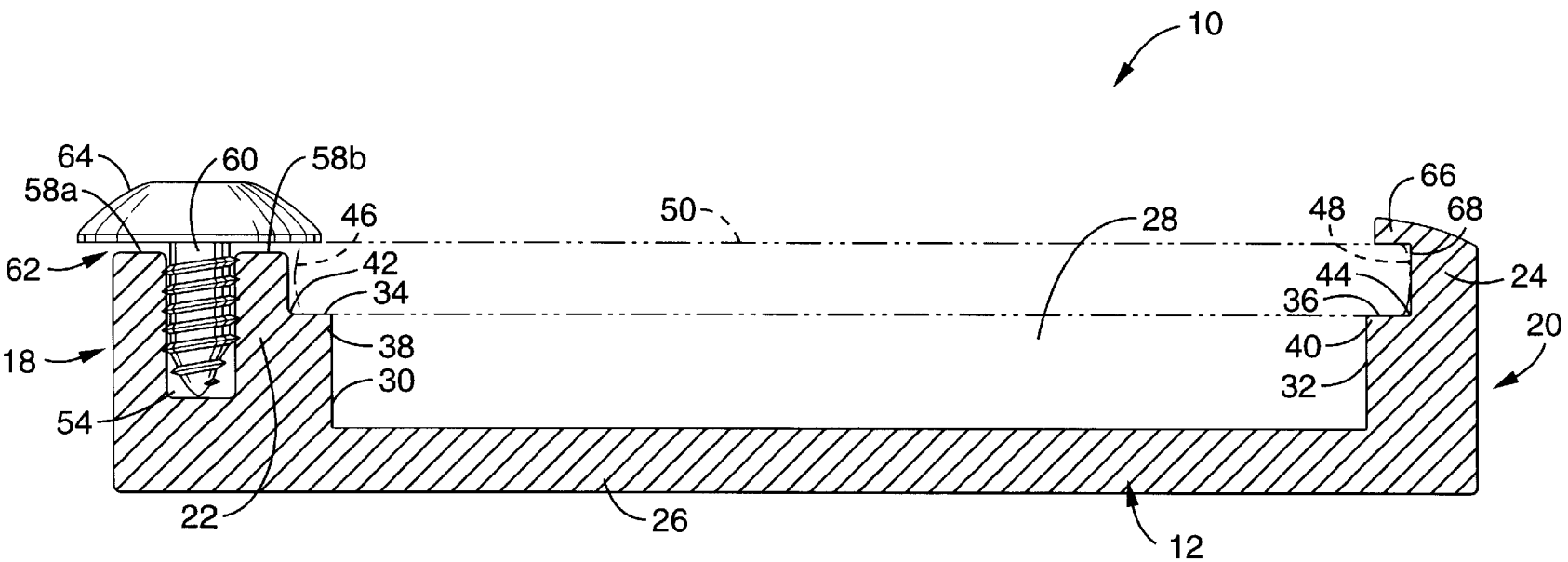
FIG. 3 is a cross-sectional view of a mounting rail shown in FIG. 1 taken through line 3—3 with the circuit board shown in phantom.

Referring to FIG. 1 through FIG. 3, one embodiment 10 of a recording sensor mounting rail assembly in accordance with the present invention is generally shown. The invention includes a mounting rail 12 which is preferably extruded from a lightweight material such as aluminum, engineering resin or the like as an elongated member having first and second ends 14, 16, and front and rear sides 18, 20. First and second elongated flanges 22, 24 are included on mounting rail 12, and extend longitudinally between first and second ends 14, 16 of mounting rail 12. Flanges 22, 24 project generally upward from a base portion 26 of mounting rail 12, and an elongated channel 28 is defined between inner walls 30, 32 of flanges 22, 24 and adjacent base portion 26.

First and second elongated shelves 34, 36 are included on first and second flanges 22, 24, respectively, of mounting rail 12. Shelves 34, 36 extend longitudinally between first and second ends 14, 16 of mounting rail 12. Referring more particularly to FIG. 3, first and second shoulders 38, 40 are included along the inner edges of shelves 34, 36 respectively adjacent inner walls or faces 30, 32 of flanges 22, 24 respectively. Shoulders 38, 40 extend longitudinally along the length of mounting rail 12 between first and second ends 14, 16. First and second corners 42, 44 are included on first and second flanges 22, 24 adjacent first and second shelves 34, 36 respectively on the outward sides thereof.

Referring more particularly to FIG. 2, shelves 34, 36 are structured and configured to receive and support the edges 46, 48 of a circuit board 50 whereon are mounted a plurality of sensors 52. Sensors 52 may comprise optical photoemitter/detectors such as Kodenshi SG 107 devices, or other types of optical or piezoelectric sensors. Edges 46, 48 of circuit board 50 fit adjacent corners 42, 44, and rest on shelves 34, 36 respectively. The position or spacing of sensors 52 on circuit board 50 may be varied as required to accommodate the configuration of piano keys, hammers, hammer shanks or the like which are to be sensed by sensors 52.

First elongated flange 22 includes a first groove 54 which extends longitudinally along first elongated flange 22. First groove 54 is parallel and adjacent to first elongated shelf 34. First groove 54 has an upward facing opening 56 defined between the upper surfaces 58*a*, 58*b* of first elongated flange 22 and is structured and configured to receive a threaded fastener 60, such as a Type AB Truss Head Phillips Machine Screw. Threaded fastener 60 is screwed into first groove 54 to hold edge 46 of circuit board 50 against first elongated shelf 34. As shown in FIG. 3, the thread diameter of threaded fastener 60 is slightly larger than the width of first groove 54. As a result, threaded fastener 60 will self-tap the material forming the sides of groove 54 and become secured in position. Alternatively, the material can be tapped to accommodate the threads of threaded faster 60. A plurality of threaded fasteners 60 can be screwed into first groove 54 to fasten edge 46 of circuit board 50. As seen in FIG. 3, a gap 62 between the upper surfaces 58*a*, 58*b* of first elongated flange 22 and the bottom of the head 64 of threaded fastener 60 allows for better compression of threaded fastener 60 on edge 46 of circuit board 50.

Second elongated flange 24 includes an inner lip 66 which extends longitudinally along second elongated flange 24. A flute 68 is defined between inner lip 66 and second elongated shelf 36 and also extends longitudinally along second elongated flange 24. Flute 68 is structured and configured to receive and support edge 48 of circuit board 50 therein.

Circuit board 50 is attached to mounting rail 12 by placing edge 48 of circuit board 50 within flute 68 whereby shelf 36 and inner lip 66 would grip and hold edge 48 in place. Edge 46 of circuit board 50 is placed onto shelf 34 of flange 22 generally flush with corner 42 and with the top of circuit board 50 being generally slightly elevated above upper surface 58*a*, 58*b* of first elongated flange 22. Threaded fastener is screwed into first groove 54 and the bottom of head 64 of threaded fastener 60 compresses edge 46 of circuit board 50 onto shelf 34, thereby holding circuit board 50 in place. Threaded fastener 60 can be placed at any point along first groove 54, and a plurality of threaded fasteners 60 can be used as required.

Figure 4:
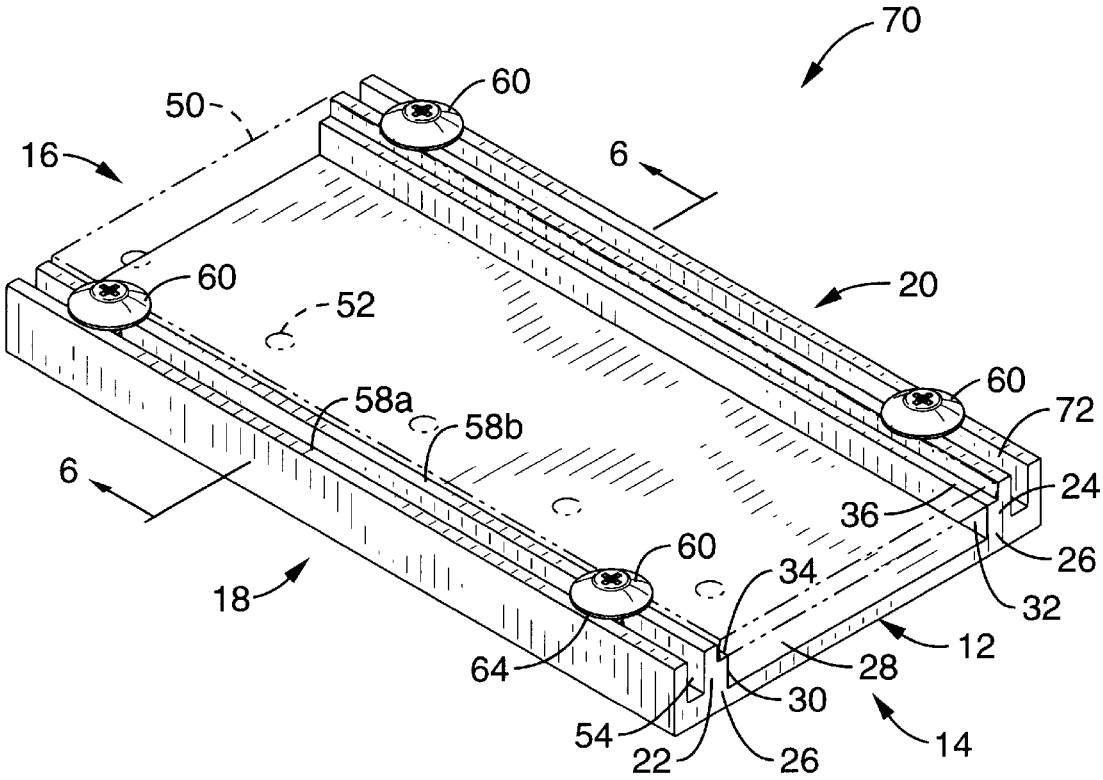
FIG. 4 is a perspective view of a second embodiment of a mounting rail assembly supporting a circuit board shown in phantom.
Figure 5:
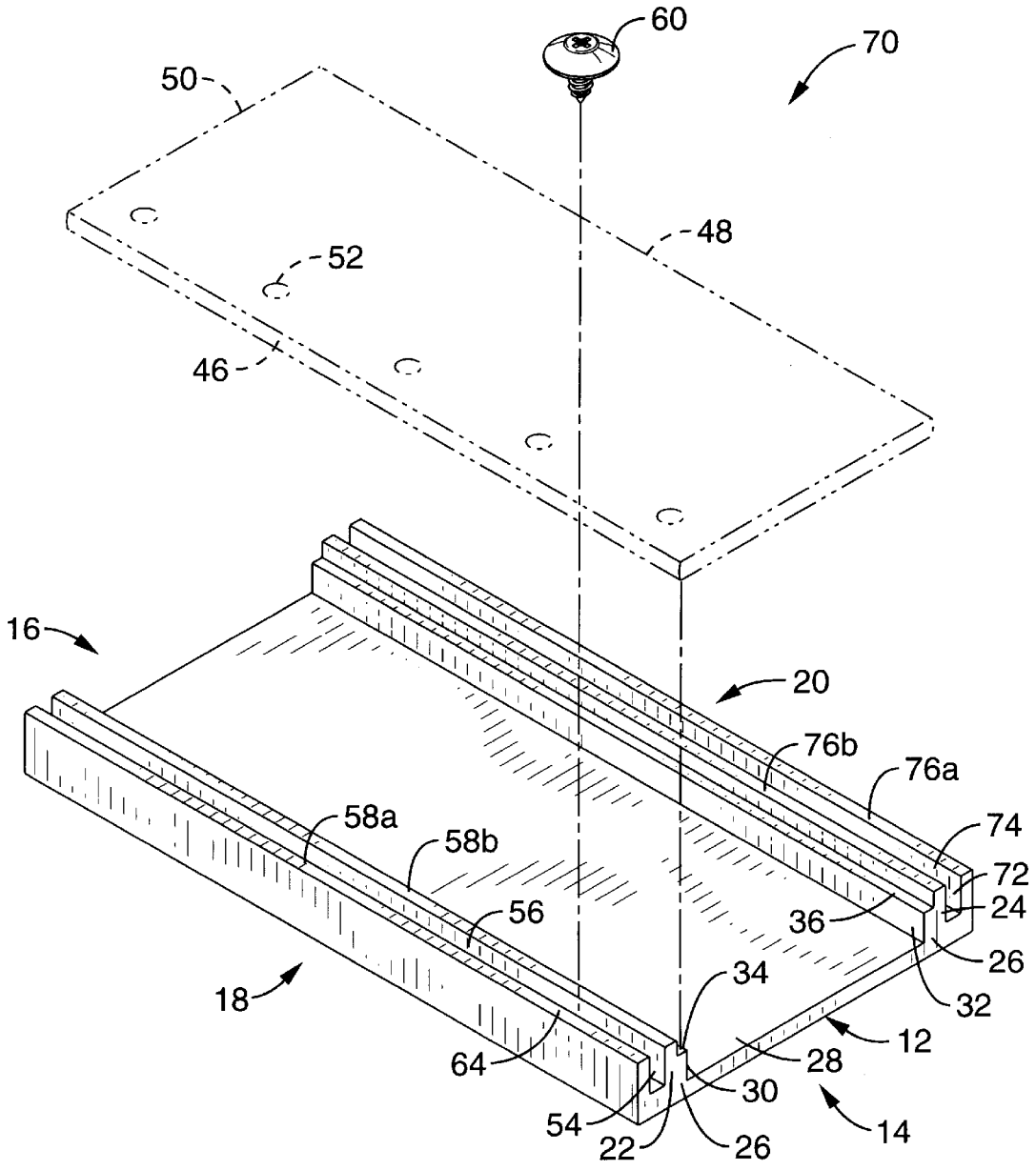
FIG. 5 is an exploded view of the assembly shown in FIG. 4.
Figure 6:
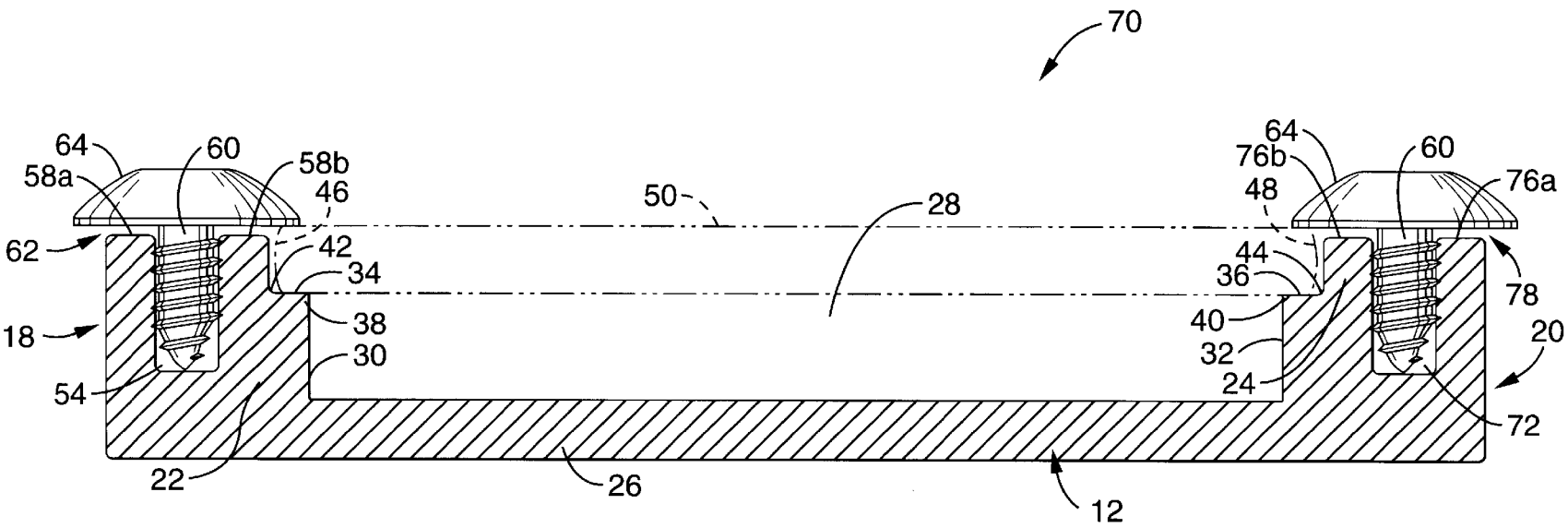
FIG. 6 is a cross-sectional view of a mounting rail shown in FIG. 4 taken through line 6—6 with the circuit board shown in phantom.

Referring to FIG. 4 through FIG. 6, a second embodiment 70 of a recording sensor mounting rail assembly in accordance with the present invention is generally shown, wherein like reference numerals denote like parts. The invention includes a mounting rail 12 which is preferably extruded from a lightweight material such as aluminum, engineering resin or the like as an elongated member having first and second ends 14,16, and front and rear sides 18, 20. First and second elongated flanges 22, 24 are included on mounting rail 12, and extend longitudinally between first and second ends 14, 16 of mounting rail 12. Flanges 22, 24 project generally upward from a base portion 26 of mounting rail 12, and an elongated channel 28 is defined between inner walls 30, 32 of flanges 22, 24 and adjacent base portion 26.

First and second elongated shelves 34, 36 are included on first and second flanges 22, 24, respectively, of mounting rail 12. Shelves 34, 36 extend longitudinally between first and second ends 14, 16 of mounting rail 12. Referring more particularly to FIG. 4, first and second shoulders 38, 40 are included along the inner edges of shelves 34, 36 respectively adjacent inner walls or faces 30, 32 of flanges 22, 24 respectively. Shoulders 38, 40 extend longitudinally along the length of mounting rail 12 between first and second ends 14, 16. First and second corners 42, 44 are included on first and second flanges 22, 24 adjacent first and second shelves 34, 36 respectively on the outward sides thereof.

Referring more particularly to FIG. 5, shelves 34, 36 are structured and configured to receive and support the edges 46, 48 of circuit board 50 whereon are mounted a plurality of sensors 52. Edges 46, 48 of circuit board 50 fit adjacent corners 42, 44, and rest on shelves 34, 36 respectively.

First elongated flange 22 includes a first groove 54 which extends longitudinally along first elongated flange 22. First groove 54 is parallel and adjacent to first elongated shelf 34. First groove 54 has a first upward facing opening 56 defined between the upper surfaces 58*a*, 58*b* of first elongated flange 22 and is structured and configured to receive a threaded fastener 60. Threaded fastener 60 is screwed into first groove 54 to hold edge 46 of circuit board 50 against first elongated shelf 34. A plurality of threaded fasteners 60 can be screwed into first groove 54 to fasten edge 46 of circuit board 50. As seen in FIG. 6, a gap 62 between the upper surfaces 58*a*, 58*b* of first elongated flange 22 and the bottom of the head 64 of threaded fastener 60 allows for better compression of threaded fastener 60 on edge 46 of circuit board 50 onto first elongated shelf 34.

Second elongated flange 24 includes a second groove 72 which extends longitudinally along second elongated flange 24. Second groove 72 has a second upward facing opening 74 defined between upper surfaces 76*a*, 76*b* and is structured and configured to receive threaded fastener 60 therein. Threaded fastener 60 is screwed into second groove 72 to hold edge 48 of circuit board 50 against second elongated shelf 36. A plurality of threaded fasteners 60 can be screwed into second groove 72 to fasten edge 48 of circuit board 50 thereon. Gap 78 between upper surfaces 76*a*, 76*b* of second elongated flange 24 and the bottom of the head 64 of threaded fastener 60 allows for better compression of threaded fastener 60 on edge 48 of circuit board 50. Circuit board 50 is attached to mounting rail 12 by placing edges 46, 48 of circuit board 50 onto shelves 34, 36, of flanges 22, 24, respectively. Edges 46, 48 of circuit board 50 are generally flush with corners 42, 44, and the top of edge 46 of circuit board 50 being generally slightly elevated above upper surface 58*a*, 58*b* of first elongated flange 22, and the top of edge 48 of circuit board 50 being generally slightly elevated above upper surface 76*a*, 76*b* of second elongated flange 24. Threaded fasteners are screwed into first and second grooves 54, 72 and the bottom of heads 64 of threaded fasteners 60 compresses edges 46, 48 of circuit board 50 onto shelves 34, 36, respectively, thereby holding circuit board 50 in place. Threaded fasteners can be positioned at any point along first and second groove 54, 72, and a plurality of threaded fasteners can be used as required.

Accordingly, it will be seen that both embodiments of the recording sensor mounting rail of the present invention provides for convenient mounting of recording sensor assemblies in association with the keyboard assembly of a keyboard operated musical instrument in a manner which can accommodate different keyboard lengths and varied key spacing. Although the description above includes many specificities, these should not be construed as limiting the scope of the invention but as merely providing illustrations of some of the presently preferred embodiments. Thus, the scope of this invention should be determined by the appended claims and their legal equivalents.

What is claimed is:

1. An apparatus for supporting a recording sensor assembly in a keyboard operated musical instrument, comprising:

(a) an elongated mounting rail having first and second ends;

(b) first and second spaced apart elongated flanges extending longitudinally between said first and second ends, respectively, of said mounting rail and defining an elongated channel therebetween;

(c) first and second elongated inner shelves extending along said first and said second elongated flanges, respectively; and (d) a first groove extending along said first elongated flange apart from said first inner shelf and configured to receive a fastener having a head capable of retaining an edge of a planar member against said first inner shelf without extending through said planar member.

2. An apparatus as recited in claim 1, wherein said first groove has a first upwardly facing opening.

3. An apparatus as recited in claim 1, wherein said second flange includes an inner lip and a flute, said flute extending along said second elongated flange and positioned between said inner lip and said second inner shelf.

4. An apparatus as recited in claim 1, wherein said second flange includes a second groove extending along said second flange apart from said second inner shelf and configured to receive a fastener therein.

5. An apparatus as recited in claim 4, wherein said second groove has a second upwardly facing opening.

6. An apparatus for supporting a recording sensor assembly in a keyboard operated musical instrument, comprising:

(a) an elongated mounting rail having first and second ends;

(b) first and second spaced apart elongated flanges extending longitudinally between said first and second ends, respectively, of said mounting rail, and defining an elongated channel therebetween;

(c) first and second elongated inner shelves extending along said first and said second elongated flange, respectively;

(d) a first groove extending along said first elongated flange apart from said first inner shelf and configured to receive a fastener having a head capable of retaining an edge of a planar member against said first inner shelf without extending through said planar member;

(e) an inner lip disposed on said second elongated flange; and (f) a flute extending along said second elongated flange and positioned between said inner lip and said second inner shelf.

7. An apparatus as recited in claim 6, wherein said first groove has a first upwardly facing opening.

8. An apparatus for supporting a recording sensor assembly in a keyboard operated musical instrument, comprising:

(a) an elongated mounting rail having first and second ends;

(b) first and second spaced apart elongated flanges extending longitudinally between said first and second ends, respectively, of said mounting rail, and defining an elongated channel therebetween;

(c) first and second elongated inner shelves extending along said first and said second elongated flange, respectively;

(d) a first groove extending along said first elongated flange apart from said first inner shelf and configured to receive a fastener having a head capable of retaining an edge of a planar member against said first inner shelf without extending through said planar; and (e) a second groove extending along said second elongated flange apart from said second inner shelf and configured to receive a fastener therein.

9. An apparatus as recited in claim 8, wherein said first groove has a first upwardly facing opening.

10. An apparatus as recited in claim 8, wherein said second groove has a second upwardly facing opening.

* * * * *